United States Patent [19]

Lemelshtrich

[11] Patent Number: 4,964,572

[45] Date of Patent: Oct. 23, 1990

[54] ROTARY SPRINKLER

[76] Inventor: Noam Lemelshtrich, Haeshel Street 57, Herzliya Pituach, Israel

[21] Appl. No.: 437,069

[22] Filed: Nov. 16, 1989

[30] Foreign Application Priority Data

Jan. 13, 1989 [IL] Israel ..... 88949

[51] Int. Cl.[5] ..... B05B 3/08; B05B 3/14

[52] U.S. Cl. ..... 239/230; 239/233

[58] Field of Search ..... 239/230, 231, 232, 233, 239/501, 503, 504, 505, 507, 509, 511, 523, 521

[56] References Cited

U.S. PATENT DOCUMENTS

| | | | |
|---|---|---|---|
| 3,022,012 | 2/1962 | Sharp et al. | 239/507 |
| 3,208,672 | 9/1965 | Sully | 239/230 |
| 3,408,009 | 10/1968 | Friedmann et al. | 239/231 |
| 4,164,324 | 8/1979 | Bruninga | 239/230 |
| 4,182,494 | 1/1980 | Wichman et al. | 239/233 |
| 4,457,470 | 7/1984 | Hauger et al. | 239/230 |

*Primary Examiner*—Andres Kashnikow
*Assistant Examiner*—Christopher G. Trainor
*Attorney, Agent, or Firm*—Banjamin J. Barish

[57] ABSTRACT

A rotary sprinkler includes a rotably-mounted sprinkler head, an oscillating arm for impacting the sprinkler head to impart a rotary motion thereto, a spring urging the oscillating arm in one direction, and a reaction member carried by the oscillating arm and having an inlet alignable with the discharge nozzle for receiving the water jet, and an outlet laterally of the inlet for imparting a rotary motion to the oscillating arm in the opposite direction by reaction. The reaction member includes a cylindrical tube bent to define a single helical loop which produces a helical path of travel of the water from its inlet to its outlet extending laterally of the discharge nozzle.

12 Claims, 2 Drawing Sheets

FIG.2
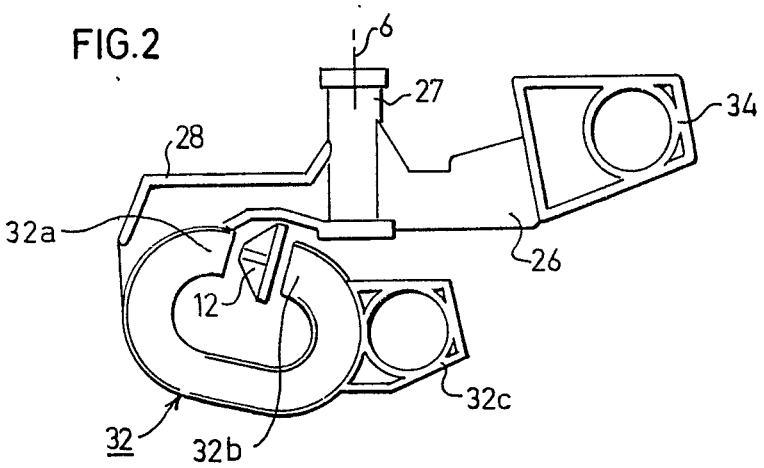
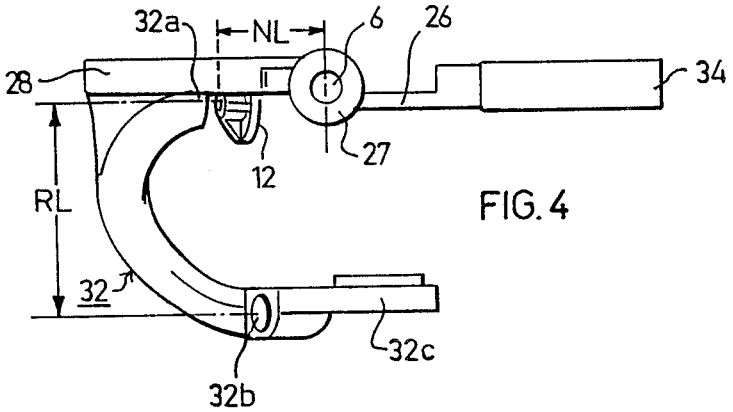
FIG. 4
FIG. 3
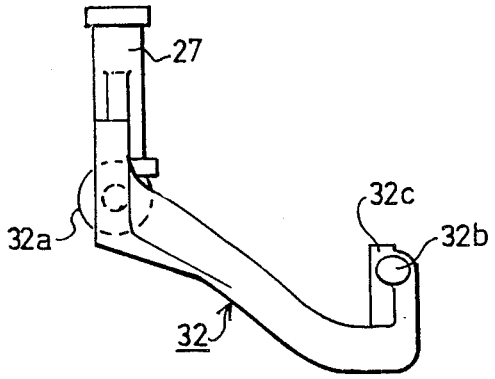

ROTARY SPRINKLER

BACKGROUND OF THE INVENTION

The present invention relates to rotary sprinklers, and particularly to the type of rotary sprinkler including a reaction member which oscillates an arm to impart the rotary motion to the sprinkler.

Rotary sprinklers of the foregoing type generally include a rotably mounted sprinkler head having a discharge nozzle discharging a water jet forwardly of the sprinkler head, an oscillating arm for periodically impacting the sprinkler head to impart a rotary motion thereto, a spring urging the oscillating arm in one direction, and a reaction member carried by the oscillating arm for moving the arm in the opposite direction by reaction forces. U.S. Pat. No. 3,022,012 discloses one such type of rotary sprinkler in which the reaction arm is of S-configuration so that the water is discharged from the outlet end of the reaction member in the same direction as that discharged from the discharge nozzle, to thereby minimize side splash. Similar constructions are described in U.S. Pat. Nos. 4,164,324 and 4,182,494, and are used in commercially-available sprinklers. In all such known constructions, the reaction member, including both its inlet and its outlet end, the axis of the reaction member is substantially planar.

I have found that such constructions produce a limited force tending to rotate the sprinkler head, and therefore if the pressure of the supply line supplying the water to the sprinkler head drops below a predetermined value, there may be insufficient force to rotate the sprinkler head especially when low discharge rates are desired. This is particularly true if the sprinkler is of the sector-type requiring sufficient energy from the water supply line not only to rotate the sprinkler head, but also to operate the reversing mechanism for reversing its direction of rotation.

OBJECTS AND SUMMARY OF THE INVENTION

An object of the present invention is to provide a rotary sprinkler, and particularly one having a novel reaction member, which produces a larger rotary force for rotating the sprinkler head in both the forward and the reverse directions, and which therefore may be used with lower water supply pressures.

According to the present invention, there is provided a rotary sprinkler comprising a rotably-mounted sprinkler head having a discharge nozzle for discharging a water jet forwardly of the sprinkler head, an oscillating arm for impacting the sprinkler head to impart a rotary motion thereto, a spring urging the oscillating arm in one direction, and a reaction member carried by the oscillating arm and having an inlet alignable with the discharge nozzle for receiving the water jet, and an outlet laterally of the inlet for imparting a rotary motion to the oscillating arm in the opposite direction by reaction; characterized in that the reaction member defines a helical path of travel of the water from its inlet to its outlet extending laterally of the discharge nozzle.

Such a construction permits the reaction member to have a larger lateral distance between its inlet and its outlet, thereby producing a larger lateral force for rotating the sprinkler head. It also provides a longer time interval between the impacts, resulting in slower manual movements, and therefore a larger range of the water discharged from the nozzle. The novel construction also provides a longer path of travel for the water used in the reaction member for rotating the sprinkler, thereby better using the energy in the water for this purpose. Accordingly, a sprinkler constructed in accordance with the foregoing features may be operated at lower water supply pressures than the previously known sprinklers and still produce a larger diameter of irrigation.

According to further important features in the preferred embodiment of the invention described below, the reaction member includes a cylindrical tube bent to define a single helical loop. The helical path of travel of the water in the reaction member extends laterally of the discharge nozzle a distance substantially greater than, e.g., approximately twice, the distance of the discharge nozzle from the axis of oscillation of the oscillating arm.

Further features and advantages of the invention will be apparent from the description below.

BRIEF DESCRIPTION OF THE DRAWINGS

The invention is herein described, by way of example only, with reference to the accompanying drawings, wherein:

FIGS. 2, 3 and 4 are side elevational, front elevational, and top plan views, respectively, illustrating only the oscillating arm and particularly its reaction member in the sprinkler of FIG. 1.

DESCRIPTION OF A PREFERRED EMBODIMENT

Figure 1:
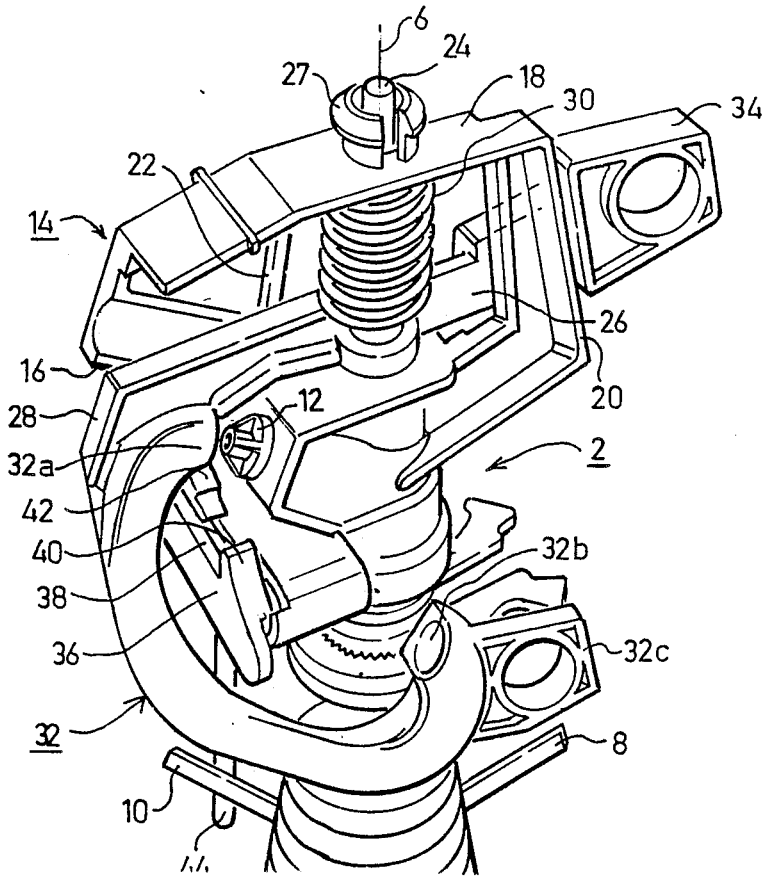
FIG. 1 is a three-dimensional view illustrating one form of rotary sprinkler constructed in accordance with the present invention.

The sprinkler illustrated in FIG. 1 is of a known sector-type sprinkler which utilizes the energy of the water for oscillating the sprinkler to distribute the water within a predetermined sector, except that the sprinkler includes an oscillating arm having a reaction member constructed in accordance with the present invention in order to utilize more of the energy of the water supplied to the sprinkler for rotating the sprinkler, and thereby enabling the sprinkler to be satisfactorily operated with lower water supply pressures.

The sprinkler illustrated in FIG. 1 comprises a sprinkler head, generally designated 2, rotatably mounted to a base 4 about a vertical axis 6. Base 4 is attached to a water supply pipe, e.g., a vertically extending riser. Base 4 also carries a pair of manually-presettable stops 8, 10, which preset the boundaries of the sector to be irrigated by the sprinkler.

Sprinkler head 2 includes a discharge nozzle 12 for discharging the water supplied via base 4 in the form of a water jet forwardly of the sprinkler head. Discharge nozzle 12 is inclined slightly upwardly so that the discharged water jet will have an upwardly directed trajectory. A bridge 14 is fixed to the sprinkler head 2 above its discharge nozzle 12. Bridge 14 includes a side wall 16 at one side of, and at the same inclination as, the discharge nozzle. Bridge 14 further includes a top wall 18, another side wall 20 at the opposite side, and a rib 22 fixed between its side wall 16 and top wall 18. Preferably, bridge 14 is integrally formed with sprinkler head 2 from plastics material, e.g., by injection molding, and rotates as a unit with the sprinkler head about its vertical axis 6.

A pin 24, e.g., of metal, is also fixed to the sprinkler head 2 so as to rotate with it about its vertical axis 6. Oscillating arm 26 is formed with a hub 27 rotatably mounted on pin 24, and includes an impact member 28 which is adapted to impact against rib 22, serving as an anvil fixed to the sprinkler head 2, in order to rotate the sprinkler head about vertical axis 6.

A coiled spring 30 applied over pin 24 urges oscillating arm 26 in the direction to cause its impact member 28 to impact against anvil 22 of the sprinkler head 2. Oscillating arm 26, however, is moved in the opposite direction, i.e., away from impact surface 22 of the sprinkler head 2, by a reaction member 32 carried by the oscillating arm. Reaction member 32 includes an inlet **32*a* for receiving the water jet exiting from discharge nozzle 12, and an outlet 32*b* laterally of the inlet 32*a* for imparting a rotary motion, by reaction forces, to the oscillating arm in the direction opposite to that to which it is urged by coiled spring 30**.

Oscillating arm 26 further includes a weight 34, at its end opposite to that of reaction member 32, for balancing purposes. A similar weight **32*c* is provided at the end of the reaction member 32**.

Sprinkler head 2 also includes a reversing mechanism 36 having a pivotal lever 38 formed with an upstanding hook 40. Hook 40 is cooperable with a hook 42 depending from reaction member 32 fixed to the oscillating arm 26. When hook 40 is in its lower position, the oscillating arm is permitted to oscillate for large strokes depending on the reaction force produced by reaction member 32, but when arm 26 is in its upper position, its hook 40 is engaged by hook 42 of the reaction member to arrest the movement of the oscillating arm 26, and thereby to produce a quick return movement of the sprinkler head.

Reversing mechanism 36 further includes a depending leg 44 pivotal to an active position as shown in FIG. 1, so that it engages the sector stops 8, 10 to actuate the reversing mechanism when the sprinkler is to irrigate sectors of the land. Leg 44 is pivotal to a horizontal, inoperative position whenever the reversing mechanism 36 is to be disabled, thereby causing the sprinkler head 2 to rotate in full-circle rather than in partial circles.

Except for the construction of the reaction member 32, the foregoing structure and operation of rotary sprinklers are well-known, and therefore further details with respect to the sprinkler structure and operation are not set forth herein. The remainder of the description is therefore directed primarily to the structure and operation of the reaction member 32 carried by the oscillating arm 26.

As shown particularly in FIG. 1, reaction member 32 is in the form of a cylindrical helical tube bent to define a single helical loop extending laterally of the discharge nozzle 12. Inlet **32*a* of the reaction member is alignable with the discharge nozzle 12 for receiving the water jet. Its outlet 32*b*, through which the water jet discharges, is located laterally of the inlet, and therefore the reaction member imparts a rotary motion to the oscillating arm 26** by reaction forces.

As shown particularly in FIG. 4, the helical reaction member 32 extends laterally of the discharge nozzle 12 a distance (RL) which is substantially greater than the distance (NL) of the tip of nozzle 12 from its axis of oscillation 6. For example, in the illustrated embodiment, the lateral distance RL between the inlet and outlet ends of the helical reaction member 32 is approximately 4 cm, whereas the distance NL between the tip of nozzle 12 and its axis of oscillation 6 is approximately 2 cm, so that distance RL is twice distance NL.

As shown particularly in FIG. 2, the axis of the outlet **32*a* of the reaction member 30 is substantially in the same horizontal plane as the axis of its inlet 32*a* an his at substantially the same inclination. Thus, the water entering inlet 32*a* of the reaction member will exit from its outlet 32*b* in the same direction as the water jet exiting from discharge nozzle 12, except that it will be displaced laterally by the distance RL, corresponding to the lateral distance between the inlet 32*a* and outlet 32*b* of the reaction member. The water intercepted by the reaction member will therefore not be splashed sideways, but rather will enter the same wetting pattern as the water exiting from the discharge nozzle 12**, so that the sprinkler will produce a minimum side splash.

OPERATION

The operation of the sprinkler illustrated in the drawings is basically the same as a conventional rotary sprinkler of this type and provides basically the same advantages, except for the additional advantages provided by the helical construction of the reaction member 32 carried by the oscillating arm 26. Thus, spring 30 normally urges oscillating arm 26 to bring its impact member 28 against anvil 22 of bridge 14 fixed to the sprinkler head 2, in which position the inlet **32*a* of reaction member 32 is aligned with the water jet exiting from discharge nozzle 12. The water jet therefore enters the inlet 32*a* of reaction member 32 and travels trough the helical path defined by it, exiting from its outlet 32*b* laterally of its inlet 32*a*. This produces a reaction force tending to move oscillating arm 26, against the force of spring 30, bringing its impact member 28 away from bridge 14 of the sprinkler head. As soon as reaction member 32 pivots its inlet 32*a* out of alignment with discharge nozzle 12, the water from the discharge nozzle ceases to enter the reaction member and rather is discharged forwardly of the sprinkler. As soon as the reaction force dissipates, spring 30 returns oscillating arm 26 and causes it to impact against anvil 22 of its bridge 14, thereby rotating the sprinkler an increment of movement. This return of the oscillating arm realigns inlet 32*a* of its reaction member 32 with nozzle 12 so as to receive another quantity of water from the nozzle, thereby causing the oscillating arm 26 to oscillate again and thereby to move the sprinkler head 2** another increment.

The reversing mechanism 36, if enabled by pivoting leg 44 to its lower operative position, cooperates with the presettable sector stops 8 and 10 in the conventional manner to define the sector pattern irrigated by the water sprinkler, as briefly described above.

A basic difference in the above-described sprinkler including the helical reaction member 32 is that this reaction member enables a large lateral distance to be provided between its inlet **32*a* and its outlet 32*b*, and thereby produces a large force for oscillating arm 26. Further, it produces a longer transit time for the water travelling through it, resulting in longer intervals between impacts, and therefore a larger range in the water discharged from the nozzle This helical construction for the reaction member 32** also provides a longer travelling path for the water used for rotating the sprinkler head, and thereby uses more of the energy within the water for this purpose. These features have been found to enable the illustrated sprinkler to be used with lower water supply pressures than the conventional sprinklers, while still deriving sufficient energy from the water supply to rotate the sprinkler and also to operate its reversing mechanism when the sprinkler is enabled for sector operation even under low rates of output of the sprinkler.

While the invention has been described with respect to one preferred embodiment, it will be appreciated that many variations, modifications and other applications of the invention may be made.

What is claimed is:

1. A rotary sprinkler, comprising a rotably-mounted sprinkler head having a discharge nozzle for discharging a water jet forwardly of the sprinkler head, an oscillating arm for impacting the sprinkler head to impart a rotary motion thereto, a spring urging said oscillating arm in one direction, and a reaction member carried by said oscillating arm and having an inlet alignable with said discharge nozzle for receiving the water jet, and an outlet laterally of the inlet for imparting a rotary motion to the oscillating arm in the opposite direction by reaction; characterized in that said reaction member defines a helical path of travel of the water from its inlet to its outlet extending laterally of the discharge nozzle.

2. The sprinkler according to claim 1, wherein said reaction member includes a cylindrical tube bent to define a single helical loop.

3. The sprinkler according to claim 1, wherein said helical path of travel of the water in the reaction member extends laterally of the discharge nozzle a substantially greater distance than the discharge nozzle from the axis of oscillation of the oscillating arm.

4. The sprinkler according to claim 1, wherein said outlet of the reaction member is in substantially the same horizontal plane as the inlet of the reaction member.

5. The sprinkler according to claim 1, wherein the outlet of the reaction member carries a balancing weight.

6. A rotary sprinkler, comprising a rotably-mounted sprinkler head having a discharge nozzle for discharging a water jet forwardly of the sprinkler head, an oscillating arm for impacting the sprinkler head to impart a rotary motion thereto, a spring urging said oscillating arm in one direction, and a reaction member carried by said oscillating arm and having an inlet alignable with said discharge nozzle for receiving the water jet, and an outlet laterally of the inlet for imparting a rotary motion to the oscillating arm in the opposite direction by reaction; said reaction member including a cylindrical tube bent to define a single helical loop producing a helical path of travel of the water from its inlet to its outlet extending laterally of the discharge nozzle.

7. The sprinkler according to claim 6, wherein said helical loop extends laterally of the discharge nozzle a substantially greater distance than the discharge nozzle from the axis of oscillation of the oscillating arm.

8. The sprinkler according to claim 6, wherein said outlet of the reaction member is in substantially the same horizontal plane as the inlet of the reaction member.

9. The sprinkler according to claim 6, wherein the outlet of the reaction member carries a balancing weight.

10. A rotary sprinkler, comprising a rotably-mounted sprinkler head having a discharge nozzle for discharging a water jet forwardly of the sprinkler head, an oscillating arm for impacting the sprinkler head to impart a rotary motion thereto, a spring urging said oscillating arm in one direction, and a reaction member carried by said oscillating arm and having an inlet alignable with said discharge nozzle for receiving the water jet, and an outlet laterally of the inlet for imparting a rotary motion to the oscillating arm in the opposite direction by reaction; said reaction member including a cylindrical tube bent to define a single helical loop to produce a helical path of travel of the water from its inlet to its outlet extending laterally of the discharge nozzle; said outlet of the reaction member being in substantially the same horizontal plane as the inlet of the reaction member.

11. The sprinkler according to claim 10, wherein said helical path of travel of the water in the reaction member extends laterally of the discharge nozzle a substantially greater distance than the discharge nozzle from the axis of oscillation of the oscillating arm.

12. The sprinkler according to claim 10, wherein the outlet of the reaction member carries a balancing weight.

* * * * *